US005246079A

United States Patent [19]

Morret

[11] Patent Number: 5,246,079

[45] Date of Patent: Sep. 21, 1993

[54] HIGH-EFFICIENCY EARTH BORING SYSTEM

[76] Inventor: Steven M. Morret, 9460 Carlisle Rd., Dillsburg, Pa. 17019

[21] Appl. No.: 951,271

[22] Filed: Sep. 28, 1992

[51] Int. Cl.[5] ..... E21B 47/00

[52] U.S. Cl. ..... 175/62

[58] Field of Search ..... 175/61, 62, 73-75, 175/94

[56] References Cited

U.S. PATENT DOCUMENTS 3,827,512 8/1974 Edmond ..... 175/62 X
4,026,371 5/1977 Takada et al. ..... 175/62 X
4,576,515 3/1986 Morimoto et al. ..... 175/62 X
5,133,418 7/1992 Gibson et al. ..... 175/62 X

*Primary Examiner*—Thuy M. Bui
*Attorney, Agent, or Firm*—Daniel O'Connor

[57] ABSTRACT

A horizontal earth boring method and system which uses hydraulic linear and rotary drives in combination with a compressed air flow to the drilling element. The compressed air flow is utilized in addition to continuously flush the bored hole which greatly increases drilling efficiency and lowers power requirements. A smaller hydraulic drive unit is thereby required and the overall system can be controlled from an out-of-ditch location.

6 Claims, 1 Drawing Sheet

HIGH-EFFICIENCY EARTH BORING SYSTEM

BACKGROUND AND OBJECTS OF THE INVENTION

This invention is generally related to the horizontal earth boring arts and, in particular, to a system for and method of efficiently achieving such earth boring.

One modern-day area in which horizontal earth boring has been required is in the drilling of smaller bores under roadways in order to pass water, sewer or electric lines from one side of the roadway to another.

Thus, if the earth beneath a roadway cannot be efficiently bored through, the roadway surface must be cut to lay a water, sewer or power line beneath it. Such operation is costly, time consuming, damaging to the roadway, and results in aggravating traffic back-ups for motorists.

Most prior art horizontal boring system have used an auger drill for the boring operation. The auger drilling systems are typically slow and often do not result in a straight-through hole being bored. For example, if the auger hits rock, it typically moves up or down thus slowing the process and resulting in a bore which is crooked.

Auger drilling systems also typically require a high horsepower drive system which is typically heavy, costly, and difficult to set up in locations beside a roadway for example.

Auger-type systems also typically require repeated withdrawal of the auger to remove debris accumulated during the boring process—thus slowing the drilling process and requiring more labor time.

Accordingly, it is an object of the present invention to demonstrate a novel horizontal boring system and method which utilizes a hammer or roller bit type drill in place of the auger drill.

It is a further object of the invention to set forth a horizontal boring system in which the drill drive means is smaller and lighter weight for ease of set-up in such locations beside a roadway.

It is a still further object of the invention to demonstrate a novel horizontal boring method in which air is or may be continuously supplied to the bore being drilled to remove debris and thus enhance and speed the drilling process.

It is also an object of the invention to set forth a horizontal boring system in which a control panel and heavier components such as a hydraulic fluid supply pump and an air compressor are located remotely from the drill moving means. Such results in a lighter and smaller drill moving means thus requiring less space and saving operation time.

It is a further object to set forth a combined air and hydraulic power boring system and method which achieves drilling efficiencies heretofore unknown in the art.

These and other objects and advantages of the present inveiton wil be apparent to those of skill in the art from the description which follows.

PRIOR ART PATENTS

The U.S. Patents which are known to be generally related to the present inveniton are as follows:

U.S. Pat. No. 3,870,110 issued Richmond in 1975 for a power train for horizontal earth boring machine.

U.S. Pat. No. 4,878,547 issued to Lennon in 1989 for a horizontal drilling assembly.

U.S. Pat. No. 4,889,193 issued to Shy in 1989 for a horizontal drilling assembly.

Each of the above systems requires use of an auger-type drill which, as previously stated, is slow in operation and frequently results in a non-straight hole being drilled when rock is encountered.

The Richmond patent requires heavy equipment to be placed in a ditch next to the drilling operation and thus requires more set-up time and operating costs.

None of the above patented systems uses air to flush the hole being drilled. While air-flushing is broadly known in the art, it has not heretofore been used in the combined manner described in this specification.

In field test results, the present invention has been found to be far superior to all known prior art systems in terms of operating costs, drilling time and drilling efficiency.

BRIEF SUMMARY OF THE INVENTION

The invention uses a light-weight and compact drill driving means which may be efficiently placed in a ditch next to earth to be bored.

The hydraulic fluid supply and compressed air supply as well as the control panel for same are placed remote from the drill driving means so that a very compact drill driving means can be utilized. Thus, a small ditch work space is required saving time and operating costs.

Air supplied to the system through hollow pipes provides a driving or hammer action for the drill head and also serves to clean out the bore continuously as the operation proceeds.

Hydraulic fluid supplied to the unit produces rotary and linear motion of the drill head.

The combined effects of the air supply for flushing the hole and the hydraulic motor drive yields a highly efficient horizontal boring system.

The overall system combination results in a light-weight drive means being placed in a ditch, thus resulting in quicker set-up time and less costly overall operation.

BRIEF DESCRIPTION OF THE DRAWING FIGURES

FULL DESCRIPTION OF THE PREFERRED EMBODIMENT

Figure 1:
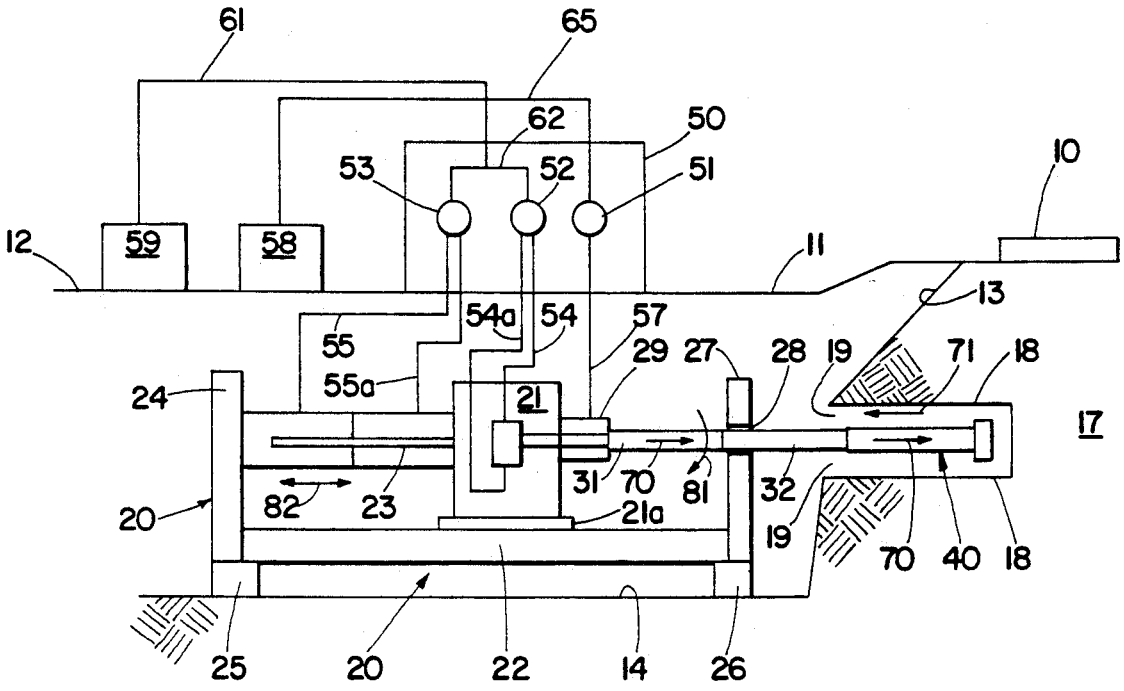
FIG. 1 shows a side view of the overall system components and illustrates the method employed in practice of the invention.
Figure 2:
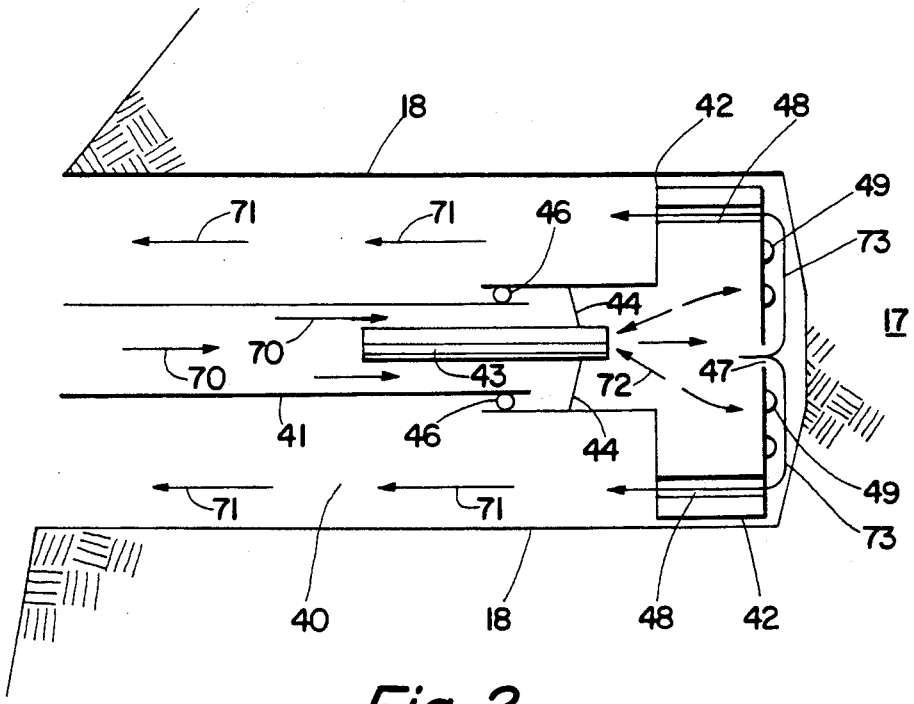
FIG. 2 shows an enlarged view of the drill pipe and drill head and illustrates the efficient air flushing methods of the invention.

Referring now to the drawing FIGS. 1 and 2, the principal components of the invention are shown in schematic form for best illustration.

As mentioned previously, one current use for the invention is in the drilling of bores through earth 17 under a roadway 10 shown in FIG. 1. The present invention performs in a far superior fashion as compared to other units for horizontal boring under roadways. Other uses for the invention such as mining, explorative drilling or construction operations will be apparent to those of skill in the art.

As shown in FIG. 1, the ground surface beside roadway 10 slopes gradually downward as indicated at numerals 11 and 12.

A narrow ditch 13 is dug beside the roadway by a backhoe or other suitable digging means. The ditch or trench 13 has a lower flattened portion 14 on which the drilling unit 20 of the invention rests.

The drilling until 20 includes a hydraulic motor unit 21 which rests on a lower table 21*a* having suitable bearing elements to slide along lower narrow rail 22. The rail 22 rests on a rear support element 25 and a forward support element 26.

The drilling unit 20 further includes a pipe guide 27 and an aperture 28 formed therein. As illustrated in FIG. 1, the hydraulic motor unit 21 is driven along the rail 22 via piston 23 and via the hydraulic fluid introduced from line 55.

Hydraulic fluid in line 55 is supplied from a hydraulic fluid source 59 such as a backhoe or other suitable supply Hydraulic fluid flows via line 61 into control panel 50 and then to valve 53. Valve 53 is manually adjustable so that hydraulic fluid can flow either to line 55 or line 55*a*.

Thus, depending on the valve 53 adjustment, the piston 23 moves either to the right or left as indicated by arrow 82. If piston 23 moves to the right, the hydraulic motor unit 21 and attached pipes 31, 32 and 40 are also moved to the right to achieve the desired earth boring.

Hydraulic fluid in line 61 is also fed, via split 62, into a valve 52 of control panel 50.

Depending upon the adjustment of valve 52, hydraulic fluid enters either line 54 or 54*a*. Entry into line 54 drives the hydraulic motor 21 in a clockwise drilling direction. The attached pipes 31, 32 and 40 are likewise driven in a clockwise direction as illustrated by arrow 81.

Entry of fluid into line 54*a* drives the hydraulic motor 21 in a counterclockwise direction to allow reversal of the drilling apparatus if desired.

It is noted that the control panel 50 and the hydraulic fluid source 59 are located out of the trench 13, 14 and are at ground level indicated by numerals 11 and 12. Such out-of-ditch location of the control panel 50 and the hydraulic source 59 means that a lighter and smaller drilling unit 20 is placed in the trench 14, thus saving digging time and labor. The use of a smaller drilling unit is important since the trench must often be dug through rock requiring use of dynamite or other costly procedures.

Up to this point, the unit described is somewhat related to the Richmond patent. Prior art horizontal boring systems, however, typically use an auger-type drill which, while effective, is slow and requires a large drive force from the drilling unit.

The present invention, in contrast, uses a hammer drill head which is continuously flushed by compressed air. The compressed air is also used to continuously flush the bore 18 of the debris which results in remarkably reduced drilling times.

Referring again to FIG. 1, the control panel 50 is also supplied with compressed air via line 65 from an air compressor 58. Note that the air compressor 58 is also located at above-trench level along ground 11 and 12.

Valve 51 in the control panel 50 controls the flow of compressed air into line 57 and thence into the drilling system.

Compressed air in line 57 is passed into a chamber 29 mounted on the hydraulic motor unit. Air thus passes into the hollow pipe chain formed by pipes 31 and 32 and the drilling pipe 40.

Compressed air flows as indicated by arrows 70 through the drill pipe 40 and then outside the hollow pipe chain along bore 18 and exits as shown at numeral 19. Arrows 71 show the exit flow of air. Thus, pulverized rock and loose dirt are continuously flushed from the hammer drill head and from the bore 18.

Referring now to FIG. 2, an enlarged view of the hammer drill pipe 40 is shown.

Numerals 70 again indicate the compressed air flow to the drill head 42 while numerals 71 show the air flow away from the drill head 42 and back toward the exit area 19 of FIG. 1.

The drill head 42 has multiple protrusions 49 formed thereon which serve the purpose of breaking up any rock encountered in drilling.

The compressed air flow, indicated by numerals 73, thus flows over and around the protrusions 49 to continuously clean debris and allow drilling to proceed smoothly.

The cylindrical drill head 42 has flattened area 48 formed thereon to allow the compressed air to flow to the return areas 71. Air exits the drill head 42 by means of at least one aperture indicated at numeral 47.

The hammer drill head 42 is caused to vibrate against the earth or rock 17 by means of a cylinder 43 formed within the unit. Cylinder 43 is attached to the drill head 42 by means of struts 44.

Thus, air flow 70 striking the cylinder 43 causes the head 42 to move relative to the drill pipe 41 by means of seal bearings shown at numeral 46. The drill head 42 is thus pushed to the right as viewed in FIG. 2.

The build-up of air pressure in the drill head 42 then serves to act against the right side of cylinder 43 as indicated by arrows 72. Thus the drill head 42 is pushed back to the left as viewed in FIG. 2.

This back-and-forth cycling of the drill head 42 repeats many times per minute, thus creating a hammering effect on the rock and earth encountered in ground 17.

The use of compressed air in the above-described fashion means that relatively low power hydraulic drive units 21 and 23 are required for the system. Thus, the overall drilling unit is smaller in size and lighter in weight. It can thus be manufactured more economically and positioned in a smaller trench 14 much more readily than prior art systems such as Richmond.

In operation of the unit to begin boring, the combined drill head and drill pipe unit 40 is threaded onto the hydraulic motor unit 21 with the drill head 42 to the right of guide member 27. Piston 23 causes the hydraulic motor unit 21 to travel to the right. Hydraulic fluid in line 54 turns the hydraulic motor 21 and thus causes the drill pipe 40 to rotate.

Compressed air supplied by line 57 causes the drill head 40 to begin its hammering action and to simultaneously flush out the bore 18.

After the drill head has penetrated several feet, the hydraulic motor 21 is stopped and the drill pipe unit 40 is disconected. The hydraulic motor unit is then backed to the left in FIG. 1 and pipe 32 is threadedly engaged between the drill pipe 40 and the hydraulic unit 21.

Drilling then proceeds several more feet as before and pipe 31 is added to the hollow pipe chain.

This procedure of adding pipes is repeated until the desired bore length is achieved.

Repeated testing of the above-described system has yielded striking results in bore straightness and even more remarkable results in reducing drilling time.

While a hammer-type drill head has been described in the above embodiment, other types of drills such as a roller bit or equivalent may also be used and employ the same air-flushing methods described above.

From the preceeding description it will be appreciated that a novel earth boring method and system has been set forth.

As previously noted, test results using the above combination have greatly reduced drilling time requirements. The novel combination of elements also results in a system which may be economically built for widespread marketing in contrast to the more costly designs currently in use.

While the hydraulic drive means 21 and 23 have been shown in broad and schematic form for best illustration, it is intended in this specification to cover all equivalent hydraulic drive means which would occur to those of skill in the art.

While a preferred embodiment has been illustrated and described, it is intended further to include all equivalent systems which would reasonably fall within the intended broad spirit and scope of the present invention.

I claim:

1. A method of horizontal boring comprising the steps of:

(a) providing a drilling unit (20) at a location next to an area to be bored, (b) providing a hydraulic motor unit (21) on said drilling unit (20), (c) sequentially attaching a chain of hollow pipes (31, 32) to said hydraulic motor unit (21), wherein a first hollow pipe (32) has a drill unit (40) attached thereto, (d) providing hydraulic fluid to said drilling unit (20) via a control panel (50) remote from said unit (20), (e) supplying compressed air to the inside of said chain of hollow pipes (31, 32) and to said drill unit (40), (f) moving said chain of hollow pipes (31, 32) transversely via said drilling unit (20), (g) rotating said chain of hollow pipes (31, 32) via said drilling unit (20), (h) supplying said compressed air through said hollow pipes (31, 32) passes through said drill unit (40) to flush the bore continuously and said air passes around said chain of hollow pipes to exit at a drill entry point (19).

2. The method of claim 1 further providing said drilling unit (20) with a relatively lightweight material and narrow in shape so that it may be placed in a narrow trench (14) adjacent the area to be bored.

3. The method of claim 2 further positioning said control panel (50) out of said trench (14) for operator safety and ease of operation.

4. The method of claim 1 further providing a hydraulic fluid supply (59) and a compressed air supply (58) located remotely from the drilling unit (20).

5. The method of claim 1 further providing said drill unit (40) with a hammer type having passageways for the compressed air to pass therethrough.

6. The method of claim 5 further providing said drill unit (40) with a drill pipe (41) and a drill head (42), wherein said drill head (42) is caused to move in a hammering motion relative to the drill pipe (41) by means of an element (43) attached to said drill head (42) via struts (44), and wherein said drill head (42) includes multiple protrusions (49) formed thereon to break rock (17) and further includes at least one air exit aperture (47), wherein said drill head (42) includes flattened portions (48) formed thereon to allow air flow to clean the bore (18) and wherein said cleaning air flow exits at a drilling entry point (19).

* * * * *